United States Patent [19]

Nicoll

[11] Patent Number: 4,546,052

[45] Date of Patent: Oct. 8, 1985

[54] HIGH-TEMPERATURE PROTECTIVE LAYER

[75] Inventor: Andrew R. Nicoll, Oftersheim, Fed. Rep. of Germany

[73] Assignee: BBC Aktiengesellschaft Brown, Boveri & Cie, Baden, Switzerland

[21] Appl. No.: 631,578

[22] Filed: Jul. 17, 1984

[30] Foreign Application Priority Data

Jul. 22, 1983 [EP] European Pat. Off. ..... 83107217.8

[51] Int. Cl.[4] ..... C25D 11/02

[52] U.S. Cl. ..... 428/679; 428/680

[58] Field of Search ..... 428/679, 680

[56] References Cited

U.S. PATENT DOCUMENTS

| | | | |
|---|---|---|---|
| 3,741,791 | 6/1973 | Maxwell | 428/679 |
| 3,761,301 | 9/1973 | Sama | 428/678 |
| 4,034,142 | 7/1977 | Hecht | 428/678 |
| 4,054,723 | 10/1977 | Higginbotham | 428/678 |
| 4,124,737 | 11/1978 | Wolfa | 428/679 |
| 4,169,726 | 10/1979 | Fairbank | 428/678 |
| 4,198,442 | 3/1980 | Gupta | 428/678 |
| 4,419,416 | 12/1983 | Gupta | 428/678 |
| 4,447,503 | 5/1984 | Dardi | 428/678 |

*Primary Examiner*—Sam Silverberg

*Attorney, Agent, or Firm*—Herbert L. Lerner; Laurence A. Greenberg

[57] ABSTRACT

A high-temperature protective layer on which a metal oxide-containing top layer forms under operating conditions. The high-temperature protective layer consists of an alloy which has an M-Cr-Al base material with which at least one metal of sub-group 4 or one transition metal of sub-group 5 of the periodic table and a metal-like material are alloyed. M represents a metallic element of sub-group 8 of the periodic table. This can be nickel, nickel/cobalt, cobalt or iron. The base material of the alloy contains silicon and zirconium or silicon and tantalum as additives.

2 Claims, No Drawings

HIGH-TEMPERATURE PROTECTIVE LAYER

BACKGROUND OF THE INVENTION

1. Field of the Invention

The invention relates to a high-temperature protective layer having a metal oxide-containing top layer, in particular for components made of an austenitic material.

2. Description of the Prior Art

Such high-temperature protective layers are used in particular where it is intended to protect the base material of components made of high-temperature steel and/or alloys, which are used at temperatures above 600° C. These high-temperature protective layers are intended to retard the action of high-temperature corrosion, especially by sulfur, oil ashes, oxygen, alkaline earth metals and vanadium. The high-temperature protective layers are applied directly to the base material of the component. In the case of components of gas turbines, high-temperature protective layers are particularly important. They are applied in particular to rotors and stators and to hot-spot segments of gas turbines. These components are preferably manufactured using an austenitic material based on nickel, cobalt or iron. In particular, superalloys of nickel are used as the base material in the manufacture of gas turbine components.

To date, it has been customary to protect components intended for gas turbines by means of a high-temperature protective layer which is formed from an alloy containing M-Cr-Al-Y as the basic material. In this formula, M represents Ni, NiCo, Co or Fe. The applied high-temperature protective layer has a matrix which incorporates an aluminum-containing phase. If a component provided with such a high-temperature protective layer is exposed to an operating temperature of more than 950° C., the aluminum present in the phase begins to diffuse to the surface, where an $Al_2O_3$ top layer is formed. A disadvantage of this is that this top layer does not possess particularly good adhesion and is therefore removed by the effect of corrosion. In the course of time, the attack by corrosion progresses so far that finally the matrix itself is attacked.

However, it has been found that it is these high-temperature protective layers, on which such top layers form, which are best suited to protect components of austenitic materials against high-temperature corrosion.

SUMMARY OF THE INVENTION

It is, therefore, an object of the invention to provide a high-temperature protective layer which has a durable top layer possessing optimum adhesion.

With the foregoing and other objects in view, there is provided in accordance with the invention a high-temperature protective layer applied to a substrate which develops a metal oxide-containing top layer when subjected to a high temperature, in particular for components made of an austenitic material, which layer comprises an alloy having an M-Cr-Al base material with which a metal of sub-group 4 or a transition metal of sub-group 5 of the periodic table and a metal-like material are alloyed, wherein M represents at least one metallic element of sub-group 8 of the periodic table.

Other features which are considered as characteristic for the invention are set forth in the appended claims.

Although the invention is illustrated and described herein as embodied in a high-temperature protective layer, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DETAILED DESCRIPTION OF THE INVENTION

The alloy according to the invention is an oxide dispersion-hardened alloy. It has a substantially better oxidation-resistance than conventional high-temperature protective layers. In the case of the applied high-temperature protective layer, it is found that it, likewise, has aluminum-containing phases which permit the formation of an alumina-containing top layer. If zirconium and silicon are alloyed with the base material which constitutes the alloy of the high-temperature protective layer, an additional aluminum-nickel-chromium oxide layer is formed on top of the alumina-containing top layer, and results in substantially better protection of the high-temperature protective layer and of the component underneath this. A further property of the high-temperature protective layer according to the invention is that it possesses substantially better adhesion to the components. This also applies to its top layer.

In a preferred embodiment, the high-temperature protective layer according to the invention consists of an alloy which contains chromium, aluminum, nickel,-silicon and zirconium. A preferred composition of this alloy contains 25 to 27% by weight of chromium, 4 to 7% by weight of aluminum, 1 to 3% by weight of silicon and 1 to 2% by weight of zirconium, nickel being the remaining component of the alloy.

A high-temperature protective layer having the same properties is obtained by using an alloy which contains chromium, aluminum, nickel silicon and tantalum. Preferably, the alloy used contains 23 to 27% by weight of chromium, 3 to 5% by weight of aluminum, 1 to 2.5% by weight of silicon and 1 to 3% by weight of tantalum, the remaining component of the alloy being nickel.

All weights are relative to the total weight of the particular alloy.

All the alloys described above are suitable for producing a high-temperature protective layer. Regardless of which of the alloys described above are used to produce the protective layer, in each case alumina top layers are formed on the protective layers under operating conditions; these top layer are not corroded away even at temperatures higher than 900° C.

The invention is illustrated in more detail by means of an example which describes the production of a coated gas turbine component. The gas turbine component to be coated is manufactured from the austenitic material, in particular a superalloy of nickel. Before the coating procedure, the component is first cleaned chemically and then roughened by sand-blasting. The coating of the component is carried out in vacuo, using the plasma spray method. The alloy used for coating contains 27% by weight of chromium, 7% by weight of aluminum, 3% by weight of silicon and 1% by weight of zirconium, the remaining component of the alloy being nickel. The weights are relative to the total weight of the alloy. The pulverulent alloy preferably has a particle size of 45 $\mu$m. Before the high-temperature protective layer is applied, the component is heated to about 800° C. by means of a plasma current. The alloy which constitutes the high-temperature protective layer is applied directly to the base material of the component. The plasma gas used comprises argon and hydrogen. The plasma current is about 580 amps, and the applied voltage is 80 volt. After application of the alloy to the component, the latter is subjected to heat treatment. This is carried out in a high-vacuum annealing furnace. In this furnace, a pressure of less than $5\times10^{-3}$ mm Hg is maintained. When a vacuum has been achieved, the furnace is heated to a temperature of 1100° C. The temperature stated above is maintained for about 1 hour, with a tolerance of about +/−4° C. The heater of the furnace is then switched off. The coated and heat-treated component is cooled slowly in the furnace. This completes its manufacture. Analysis of the applied high-temperature protective layer shows that it has a matrix composition which contains 28% by weight of chromium, 3% by weight of silicon, 3.6% by weight of aluminum and nickel. Furthermore, it is possible to detect two phases which have separated out, one of these phases containing 14.4% by weight of aluminum, 2.4% by weight of silicon, 8.9% by weight of chromium and nickel. The second phase contains 11% by weight of silicon, 26% by weight of zirconium, 4% by weight of chromium and nickel.

Using the same method, it is also possible to apply a high-temperature protective layer which has a nickel-chromium-aluminum base material with which silicon and tantalum are alloyed. To produce a high-temperature protective layer of this type, an alloy consisting of 27% by weight of chromium, 5% by weight of aluminum, 2.5% by weight of silicon and between 0 and 3% by weight of tantalum is preferably used.

Investigations of such a high-temperature protective layer which is applied to a component by means of the method described above show that the high-temperature protective layer has a matrix composition which contains 27% by weight of chromium, 3% by weight of aluminum, 2.4% by weight of silicon and 0.7% by weight of tantalum, the remainder consisting of nickel. Moreover, when the high-temperature protective layer is formed, a phase separates out which contains 8.5% by weight of aluminum, 1.8% by weight of silicon, 5.8% by weight of tantalum and 5.8% by weight of chromium, the remainder consisting of nickel.

The foregoing is a description corresponding, in substance, to European Application Nr. 83 10 7217.8, dated July 22, 1983, international priority of which is being claimed for the instant application, and which is hereby made part of this application. Any material discrepancies between the foregoing specification and the specification of the aforementioned corresponding European application are to be resolved in favor of the latter.

There is claimed:

1. A high temperature protective layer having an alumina containing top layer comprising an oxide dispersion-hardened alloy having a base material of 25–27% by weight of chromium, 4 to 7% by weight of aluminum relative to the total weight of the alloy and the remaining component of the base material is nickel and the alloy contains as additives 1 to 3% by weight silicon and 1 to 2% by weight of zirconium relative to the total weight of the alloy.

2. A high temperature protective layer having an alumina-containing top layer comprising an oxide dispersion-hardened alloy having a base material of 23 to 27% by weight of chromium, 3 to 5% by weight of aluminum relative to the total weight of the alloy and the remaining component of the base material is nickel and the alloy contains as additives 1 to 3% by weight tantalum and 1 to 2.5% by weight of silicon relative to the total weight of the alloy.

* * * * *